US009251939B1

(12) United States Patent
Miyamoto et al.

(10) Patent No.: US 9,251,939 B1
(45) Date of Patent: Feb. 2, 2016

(54) STATIONARY INDUCTION ELECTRIC APPARATUS

(71) Applicant: Hitachi, Ltd., Tokyo (JP)

(72) Inventors: Naoya Miyamoto, Tokyo (JP); Satoshi Ichimura, Tokyo (JP); Naoyuki Kurita, Tokyo (JP)

(73) Assignee: HITACHI, LTD., Tokyo (JP)

( * ) Notice: Subject to any disclaimer, the term of this patent is extended or adjusted under 35 U.S.C. 154(b) by 0 days.

(21) Appl. No.: 14/686,079

(22) Filed: Apr. 14, 2015

(30) Foreign Application Priority Data

Aug. 8, 2014 (JP) ..... 2014-162020

(51) Int. Cl.
*H01F 27/24* (2006.01)
*H01F 3/04* (2006.01)
*H01F 17/06* (2006.01)

(52) U.S. Cl.
CPC ..... *H01F 3/04* (2013.01); *H01F 17/062* (2013.01); *H01F 27/24* (2013.01)

(58) Field of Classification Search
CPC ..... H01F 27/00–27/36
USPC ..... 336/212, 233–234, 220–223
See application file for complete search history.

(56) References Cited

U.S. PATENT DOCUMENTS 5,210,930 A * 5/1993 Watabe ..... H01F 41/0213 29/609
6,407,655 B1 * 6/2002 Kitamura ..... H01F 41/0213 336/213
7,057,489 B2 6/2006 Nathasingh et al.
2002/0067239 A1 * 6/2002 Nathasingh ..... H01F 41/0213 336/234

FOREIGN PATENT DOCUMENTS

CN 201820598 U 5/2011
JP 2009-296005 A 12/2009

* cited by examiner

*Primary Examiner* — Tuyen Nguyen
(74) *Attorney, Agent, or Firm* — Mattingly & Malur, PC

(57) ABSTRACT

An iron core is configured as a winding iron core block group that is obtained in such a manner that winding iron core blocks having rectangular cross-sections each of which is obtained by laminating magnetic metal ribbons with a predetermined width and which have plural widths and laminated thicknesses are arranged in the width direction of the magnetic metal ribbons. The laminated thickness of the winding iron core block located in the middle of the width direction of the magnetic metal ribbons is larger, and the cross-section of each iron core leg is configured substantially in a circular shape by centering the winding iron core blocks in the laminated direction of the magnetic metal ribbons. Upper and lower yokes are arranged in such a manner that the bottom faces of the winding iron core blocks are aligned, and an in-window support member supports the upper yoke on a plane.

8 Claims, 10 Drawing Sheets

STATIONARY INDUCTION ELECTRIC APPARATUS

BACKGROUND

The present invention relates to a stationary induction electric apparatus such as a transformer or a reactor, and particularly to a stationary induction electric apparatus in which an iron core is configured using a winding iron core.

Most of stationary induction electric apparatuses such as transformers or reactors have iron cores configured using magnetic material, and a structure called "winding iron core" has been widely used, particularly, for an iron core of a stationary induction electric apparatus with a relatively-small capacity of a few MVAs or lower to improve workability. The winding iron core is generally configured by circularly bending laminated magnetic metal ribbons cut in a strip shape. In the case of a winding iron core having the simplest structure, the magnetic metal ribbons with the same width are laminated to configure the winding iron core. In this case, the cross-section of the winding iron core that is orthogonal to a closed curve drawing the circle of the iron core is generally formed in a rectangular shape.

The winding of the stationary induction electric apparatus having the iron core is wound around the outer edge of the cross-section of the iron core as close as possible. It is reasonable to maximize the space factor that is a ratio of the area occupied by the cross-section of the iron core to the area occupied by the winding. The dimension of the main body of the stationary induction electric apparatus and the loss can be reduced by maximizing the space factor. Accordingly, a winding is wound in a rectangular shape in many cases in the case of a winding iron core having a rectangular cross-section. Alternatively, a winding is wound in an oval shape or in a racetrack manner in many cases due to workability such as bending of electric wires configuring the winding.

Further, it is required for a winding to withstand electromagnetic force generated when current accidentally flows. In general, when the capacity of the stationary induction electric apparatus is increased, the electromagnetic force becomes large. When the electromagnetic force to withstand becomes large, a circular winding is generally economical to satisfy the electromagnetic force resistance as compared to that formed in a rectangular, oval, or racetrack shape.

Thus, a circular winding is selected for a stationary induction electric apparatus with a relatively-large capacity of a few MVAs or larger, and the space factor is considerably reduced in the case of an iron core having a rectangular cross-section. Accordingly, the cross-section of the iron core is required to be formed nearly in a circular shape, and an iron core with substantially a circular cross-section of a laminated iron core is adopted for a stationary induction electric apparatus with a large capacity. The laminated iron core configures an iron core circle by combining elements obtained in such a manner that magnetic metal ribbons having various shapes are combined and laminated in a circle of a frame shape. The iron core circle is generally in a frame shape, and the widths of the magnetic metal ribbons configured by laminating the iron core circle are changed to realize an iron core with substantially a circular cross-section.

As described in Japanese Unexamined Patent Application Publication No. 2009-296005, there is a well-known method for a winding iron core in which an iron core with substantially a circular cross-section is realized by changing the widths of magnetic metal ribbons while laminating the same as similar to the laminated iron core, and the iron core is wound in a circular shape to configure a winding iron core with substantially a circular cross-section. Further, the iron core is divided into plural sections in the middle of the circle as described in Japanese Unexamined Patent Application Publication No. 2009-296005.

SUMMARY

In order to increase the capacity of a stationary induction electric apparatus, it is desirable that a winding is wound in a circular shape to improve the electromagnetic force resistance and the cross-section of an iron core is formed in a circular shape to improve the space factor in accordance with the winding. Further, if the iron core can be realized using a winding iron core, the manufacturing process can be shortened, leading to the improvement of economics.

The technique described in Japanese Unexamined Patent Application Publication No. 2009-296005 is advantageous in that while using a general method of realizing the circular cross-section using the winding iron core, the lengths of the magnetic metal ribbons handled at a time are prevented from being increased by dividing the winding iron core into plural sections in the middle of the circle, and the improvement of workability and the expansion of producible capacity in facilities can be realized. On the other hand, unlike a laminated iron core with a circular cross-section that is common in a large-capacity apparatus, it is necessary to provide a support structure in a window to support the iron core because wider faces of the magnetic metal ribbons are located inside the window of the iron core, and further the support member is complicated due to the circular cross-section. Thus, the size of the window is increased, and the amount of use of iron core material is disadvantageously increased.

An object of the present invention is to provide a stationary induction electric apparatus having a simple iron core support structure and having a winding iron core with a circular cross-section in which plural winding iron cores with rectangular cross-sections of the stationary induction electric apparatus are arranged in the width direction of magnetic metal ribbons configuring the winding iron core to form one winding iron core, the laminated thickness of each winding iron core with a rectangular cross-section is changed, the respective rectangular cross-sections are centered in the laminated direction to be formed in a circular shape in a space inside the winding, and faces of yokes of the iron core inside a window of the winding iron core with a rectangular cross-section are aligned on the same plane.

In order to address the above-described problem, the present invention provides a stationary induction electric apparatus the main body of which is configured by including an iron core having, at least, two iron core legs and a winding wound around each iron core leg. The iron core is a winding iron core obtained by bending laminated magnetic metal ribbons in a circular shape, and the winding iron core is configured using a winding iron core block group in which plural winding iron core blocks each of which has a rectangular cross-section and which have different laminated thicknesses are arranged in the width direction of the magnetic metal ribbons. The cross-section of the iron core in the width direction and the laminated direction of the magnetic metal ribbons becomes a stepped circular cross-section in the case of an iron core leg, and straight sides are located in a window in the case of a yoke. Accordingly, the yoke in the window can be supported on a plane, and a support structure for the iron core can be simplified.

According to the present invention, in the case where a winding iron core with a circular cross-section is applied to a stationary induction electric apparatus, support structures of yokes can be simplified, the size of a window of the iron core can be minimized, and the dimension of the iron core can be reduced.

DETAILED DESCRIPTION

In the present invention, an iron core of a stationary induction electric apparatus is configured using a winding iron core block group in such a manner that plural winding iron core blocks having different laminated thicknesses and rectangular cross-sections each of which is obtained by bending laminated magnetic metal ribbons in a circular shape are arranged and combined in the width direction of the magnetic metal ribbons. The cross-section of the iron core in the width direction and the laminated direction of the magnetic metal ribbons becomes a stepped circular cross-section in the case of an iron core leg, and straight sides are located in a window in the case of a yoke. Accordingly, the yoke in the window can be supported on a plane, and a support structure for the iron core can be simplified.

First Embodiment

Figure 1:
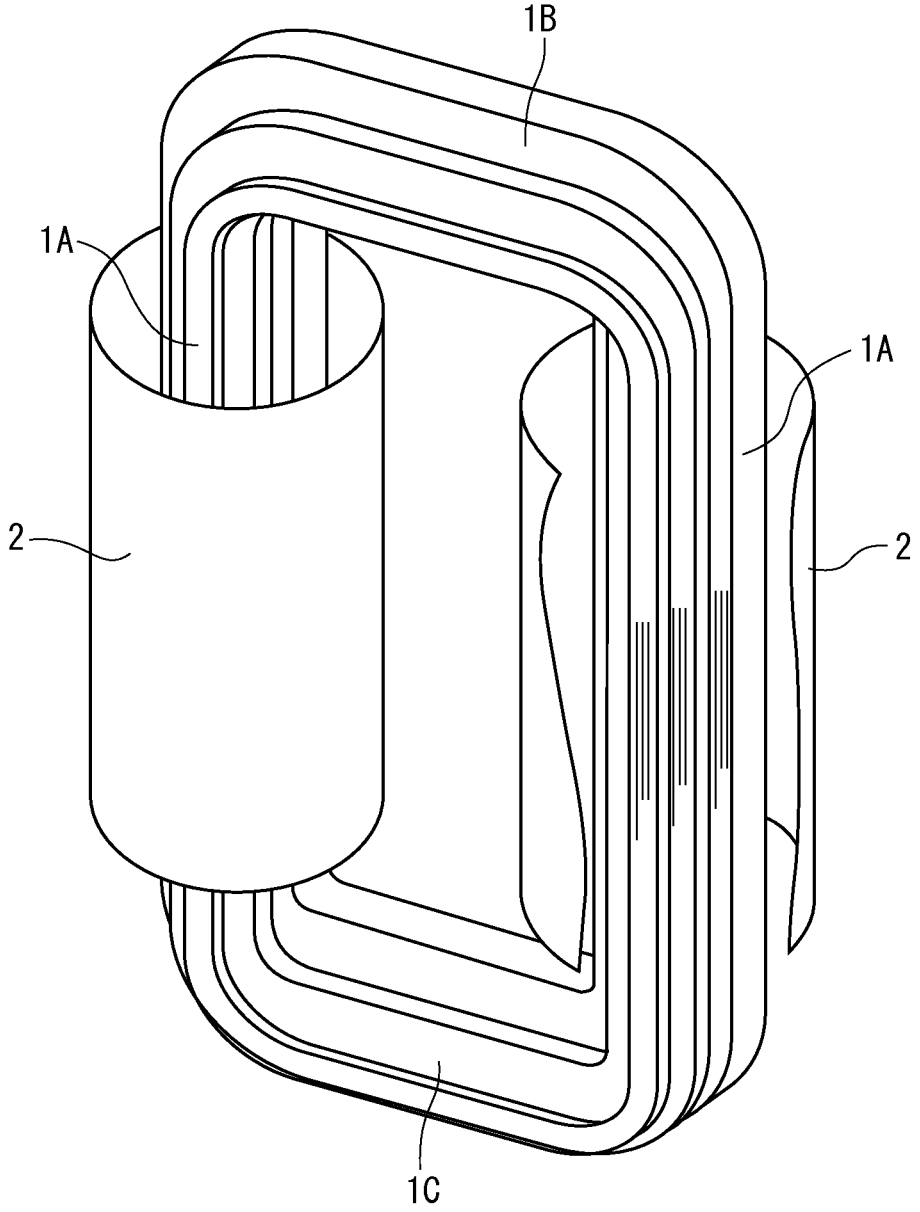
FIG. 1 is a configuration diagram as a first embodiment of a transformer to which the present invention is applied.

Embodiments of the present invention will be described using FIG. 1 to FIG. 10. FIG. 1 shows a main body structure of a stationary induction electric apparatus according to a first embodiment to which the present invention is applied. The main body of the electric apparatus of FIG. 1 has a single-phase two-leg structure configured using: a winding iron core 1 having two iron core legs 1A and an upper yoke 1B and a lower yoke 1C that magnetically connect between the iron core legs 1A; and a winding 2 wound around each iron core leg. The main body of the electric apparatus of FIG. 1 is installed in the gravity direction such as the downward direction in the drawing. The iron core 1 is a circular winding iron core obtained by bending laminated magnetic metal ribbons.

Figure 2:
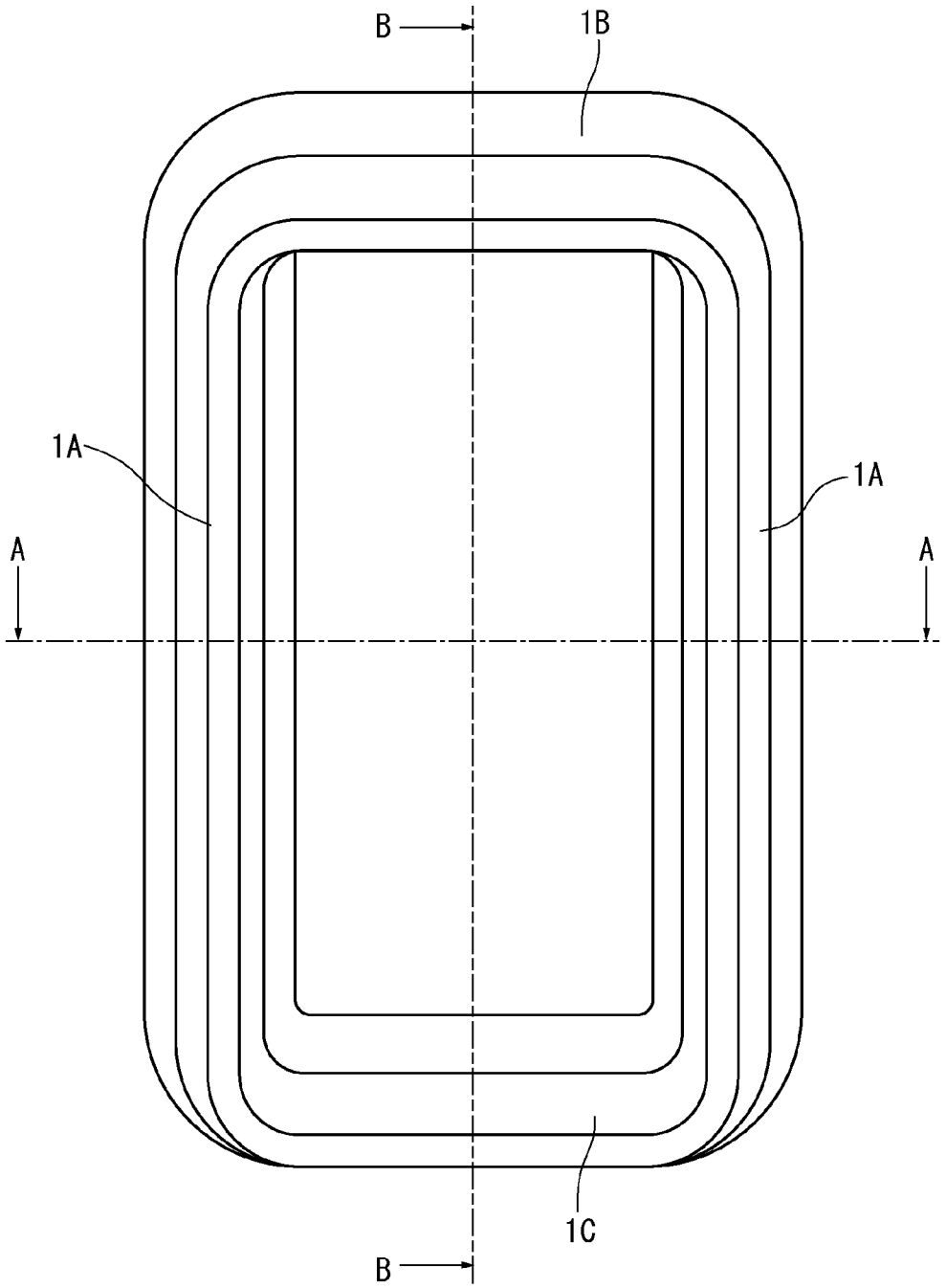
FIG. 2 is a perspective view of a window of an iron core of FIG. 1 viewed from the front direction.
Figure 3:
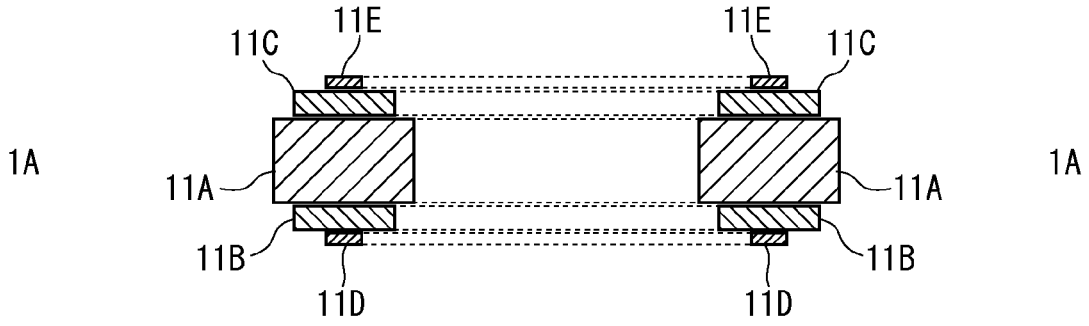
FIG. 3 is a cross-sectional view of the iron core taken along the line A-A of FIG. 2.
Figure 4:
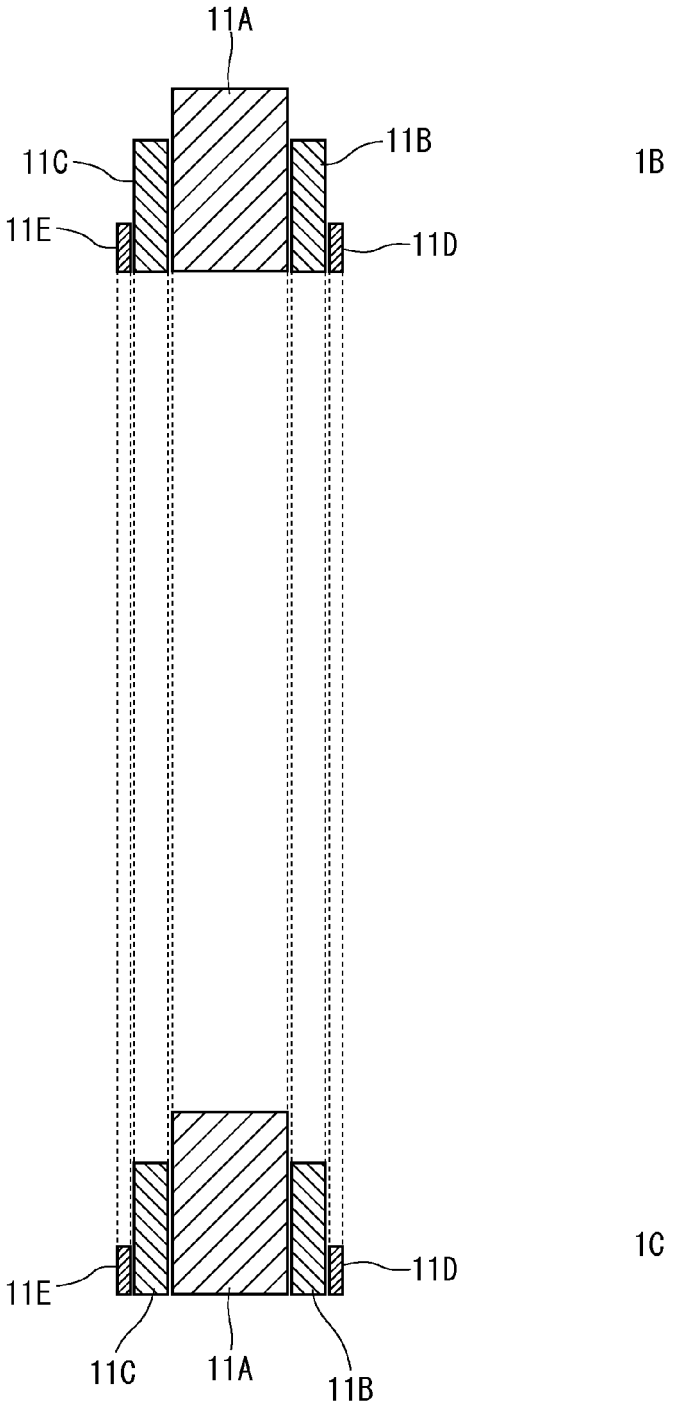
FIG. 4 is a cross-sectional view of the iron core taken along the line B-B of FIG. 2.
Figure 5:
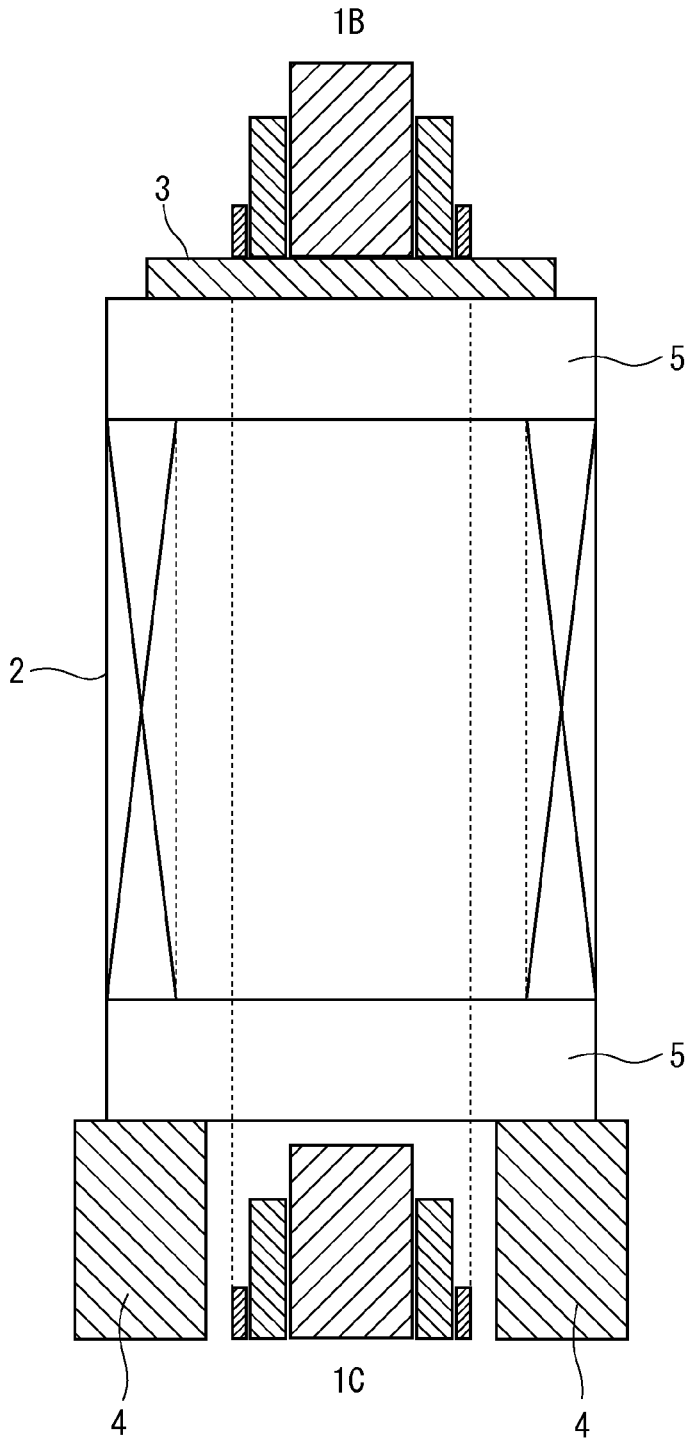
FIG. 5 is a configuration diagram in which a winding, a support member, and an insulating structure are added to the cross-sectional view of the iron core of FIG. 4 as a configuration example of an actual transformer.

The present invention is particularly applied to means allowing the iron core leg 1A of the winding iron core shown in FIG. 1 to have a circular cross-section, the cross-sectional shapes of the upper and lower yokes 1B and 1C, and a support structure. FIG. 2 shows a perspective view of a window of the iron core 1 viewed from the front direction. As shown in FIG. 2 to FIG. 4, the iron core 1 is configured as a winding iron core block group that is obtained in such a manner that winding iron core blocks 11A to 11E having rectangular cross-sections each of which is obtained by laminating magnetic metal ribbons with a predetermined width and which have plural widths and laminated thicknesses are arranged in the width direction of the magnetic metal ribbons. The laminated thickness of the winding iron core block nearer the middle of the width direction of the magnetic metal ribbons is larger, and the winding iron core block located in the middle of the width direction of the magnetic metal ribbons is wider than those located at the both ends. The cross-section of each iron core leg 1A taken along the line A-A of FIG. 2 is configured substantially in a circular shape by centering the winding iron core blocks 11A to 11E in the laminated direction of the magnetic metal ribbons as shown in FIG. 3. The cross-sections of the upper and lower yokes 1B and 1C taken along the line B-B of FIG. 2 are arranged in such a manner that the bottom faces of the winding iron core blocks 11A to 11E are aligned as shown in FIG. 4, and an in-window support member 3 for supporting the upper yoke supports the upper yoke 1B on a plane as shown in FIG. 5. The lower yoke 1C is arranged on a surface on which the main body of the electric apparatus is installed, and thus does not particularly need a support member. Each of lower support members 4 of FIG. 5 is arranged to mainly support the winding 2. The windings 2 are fixed and supported by the in-window support member 3 and the lower support members 4 through insulating structural members 5. The in-window support member 3 is illustrated as the simplest flat plate. However, a stay or a bolt hole may be provided as long as the in-window support member 3 is structured to be brought into contact with the upper yoke 1B on a plane. Each of the lower support members 4 is illustrated as the simplest rectangular pillar, but is not limited to this shape. Each of the lower support members 4 may be formed in a rectangular pipe shape, an inverse C-shape, an I-shape, or an H-shape. Further, a stay or a bolt hole may be provided. Further, the iron core 1 may be bound by a fastening band. According to these structures, the support structures for the upper and lower yokes 1B and 1C can be simplified in the stationary induction electric apparatus in which the iron core legs LA are erected and installed in the gravity direction. Therefore, the dimension of the window can be minimized, and the amount of use of iron core material can be reduced. Thus, a rational winding iron core with a circular cross-section can be realized.

In the embodiment, an example of a configuration using five winding iron core blocks is shown. However, the similar configuration can be realized using three or more winding iron core blocks.

Second Embodiment

Figure 6:
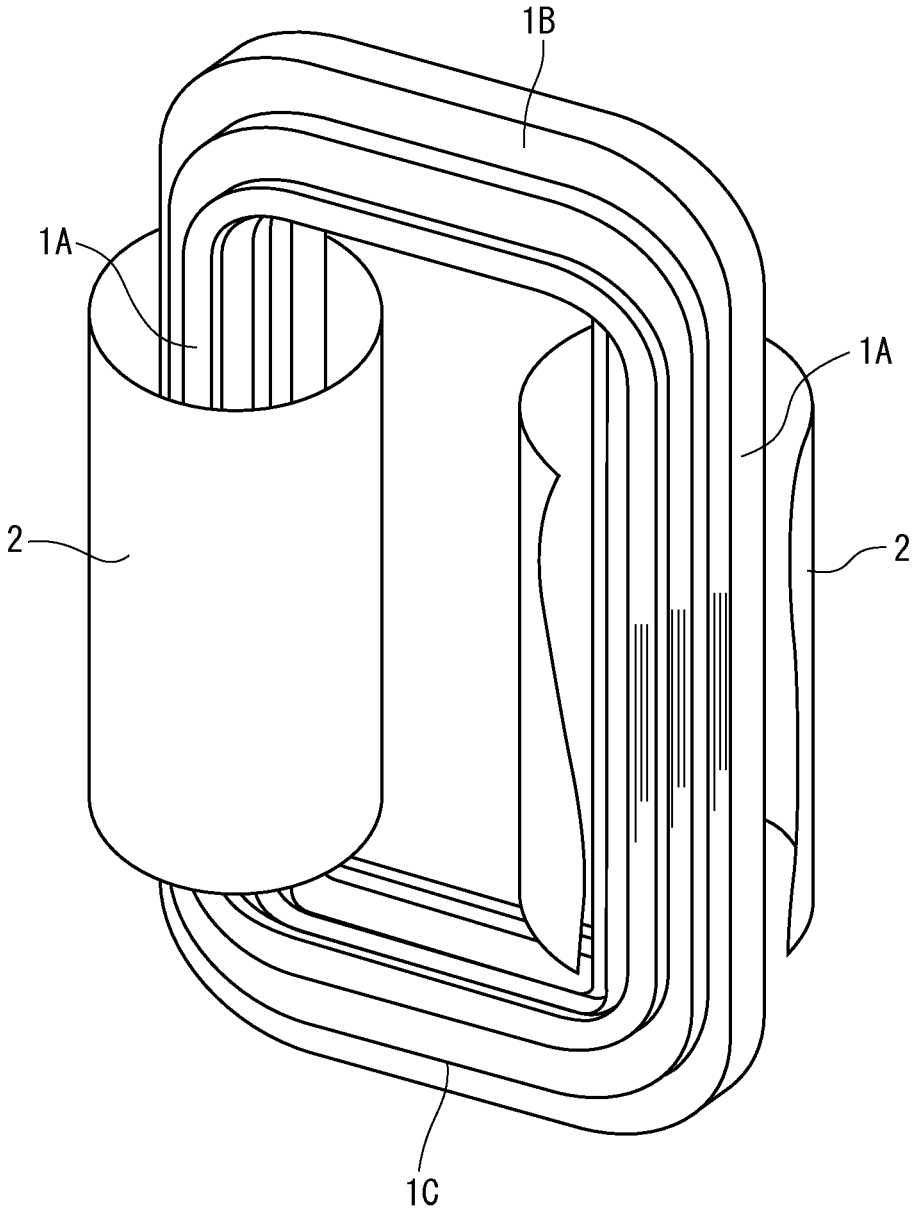
FIG. 6 is a configuration diagram as a second embodiment of a transformer to which the present invention is applied.

FIG. 6 shows a structure of an iron core of a second embodiment to which the present invention is applied. The configurations other than the iron core structure are the same as FIG. 1, and the main body of the electric apparatus has a single-phase two-leg structure configured using: an iron core 1 having two iron core legs 1A and two yokes 1D that magnetically connect between the two iron core legs; and a winding 2 wound around each iron core leg. The iron core is a circular winding iron core obtained by bending laminated magnetic metal ribbons. In the second embodiment, the direction in which the electric apparatus is installed is not limited.

Figure 7:
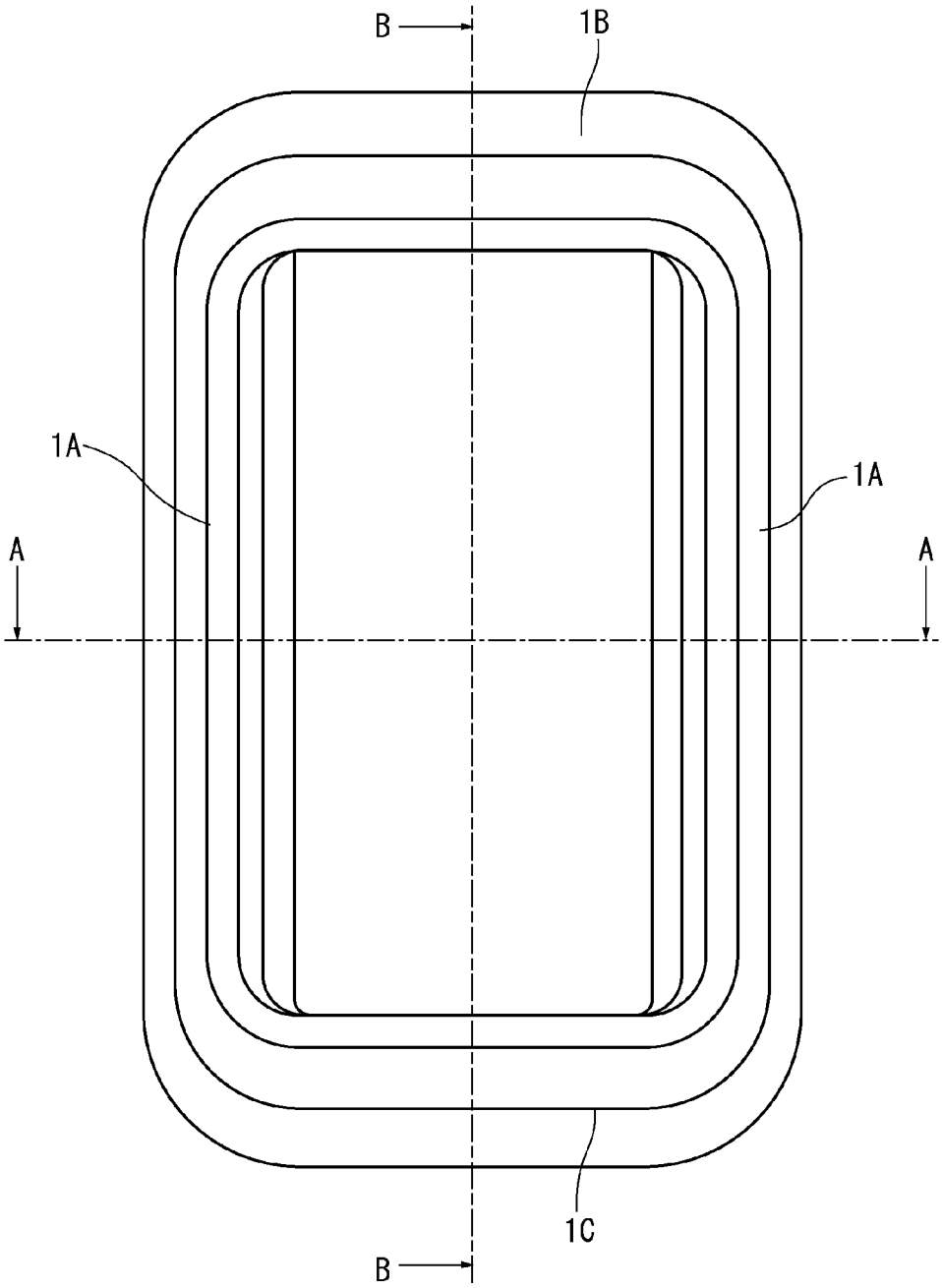
FIG. 7 is a perspective view of a window of an iron core of FIG. 6 viewed from the front direction.
Figure 8:
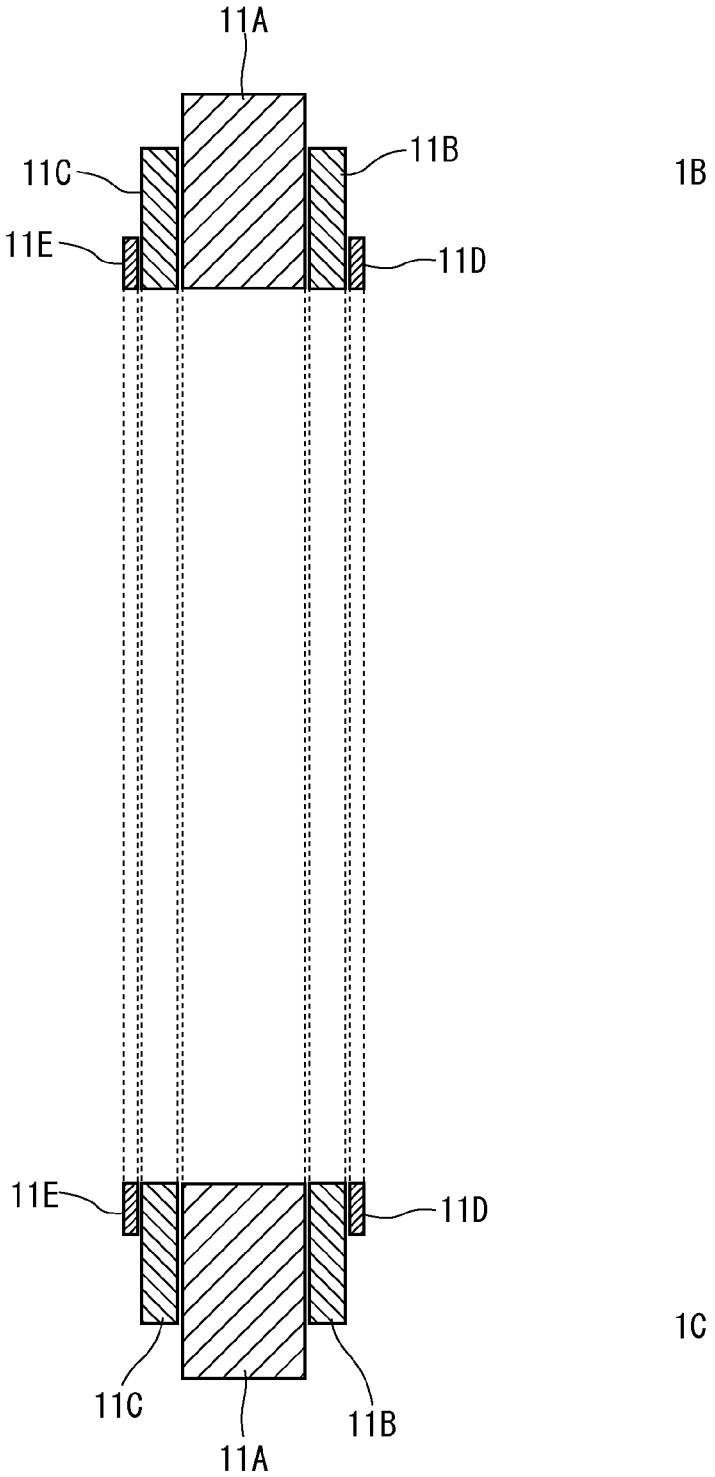
FIG. 8 is a cross-sectional view of the iron core taken along the line A-A of FIG. 7.
Figure 9:
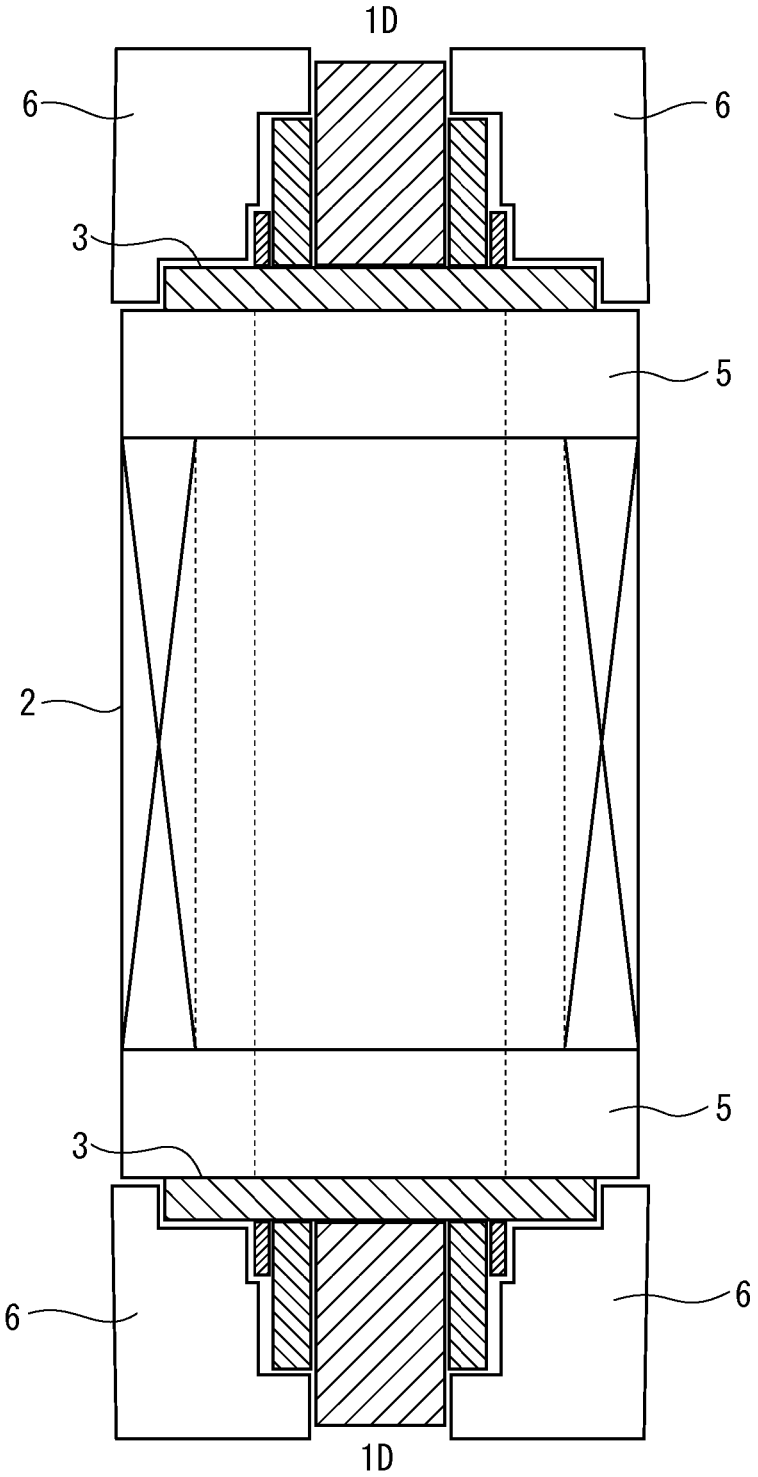
FIG. 9 is a cross-sectional view of the iron core taken along the line B-B of FIG. 7.
Figure 10:
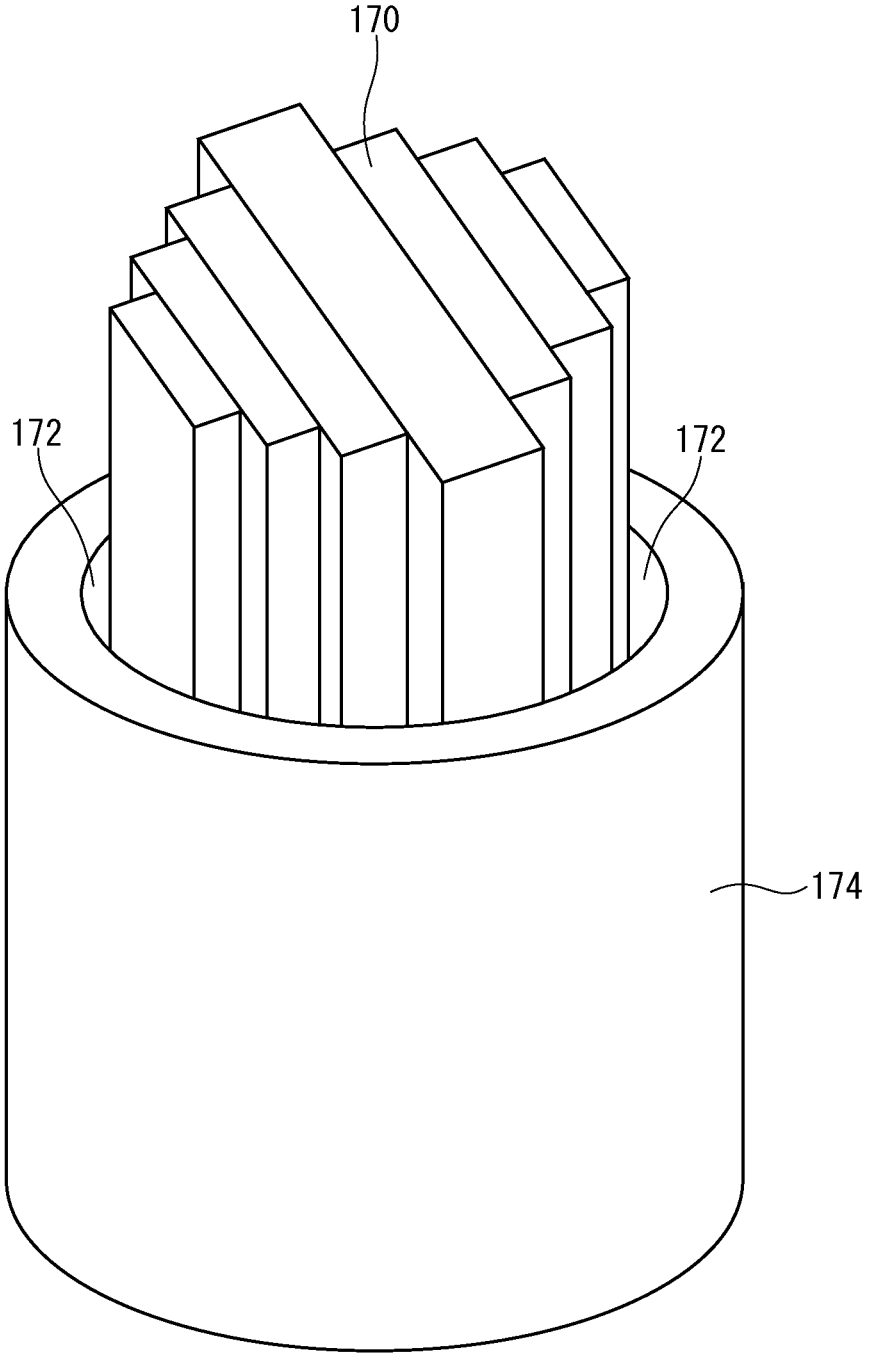
FIG. 10 is a configuration diagram in which a winding, a support member, and an insulating structure are added to the cross-sectional view of the iron core of FIG. 9 as a configuration example of an actual transformer.

FIG. 7 shows a perspective view of a window of the winding iron core 1 of FIG. 6 viewed from the front direction. As shown in FIG. 7 to FIG. 9, as similar to the first embodiment, the iron core 1 is configured as a winding iron core block group that is obtained in such a manner that winding iron core blocks 11A to 11E having rectangular cross-sections each of which is obtained by laminating magnetic metal ribbon with a predetermined width and which have plural widths and laminated thicknesses are arranged in the width direction of the magnetic metal ribbons. The laminated thickness of the winding iron core block nearer the middle of the width direction of the magnetic metal ribbons is larger, and the winding iron core block located in the middle of the width direction of the magnetic metal ribbons is wider than those located at the both ends. The cross-section of each iron core leg 1A taken along the line A-A of FIG. 7 is configured substantially in a circular shape by centering the winding iron core blocks 11A to 11E in the laminated direction of the magnetic metal ribbons as similar to FIG. 3. The cross-sections of the yokes 1D taken along the line B-B of FIG. 7 are arranged in such a manner that the faces of the winding iron core blocks 11A to 11E inside the window are aligned as shown in FIG. 8, and in-window support members 3 and stepped support members 6 are arranged to support the yokes as shown in FIG. 9. The windings 2 are fixed and supported by the in-window support members 3 and the stepped support members 6 through insulating structural members 5. The stepped support members are structures outside the window. Thus, the stepped support members do not affect the dimension of the iron core, and can be easily installed because a work space can be easily secured. Each of the in-window support members 3 is illustrated as the simplest flat plate. However, a stay or a bolt hole may be provided as long as each of the in-window support members 3 is structured to be brought into contact with the upper yoke 1B on a plane. A stay or a bolt hole for reinforcement may be provided to each of the stepped support members 6. The iron core may be bound by a fastening band, and thus the in-window support members 3 and the stepped support members 6 may be partially omitted. According to these structures, it is possible to realize a rational winding iron core with a circular cross-section in which the supports for the yokes 1D can be easily realized, and the amount of use of material is reduced by minimizing the dimension of the window of the iron core 1.

In the embodiment, an example of a configuration using five winding iron core blocks is shown. However, the similar configuration can be realized using three or more winding iron core blocks.

It should be noted that the present invention is not limited to the single-phase two-leg structure of FIG. 1 or 6, but may be a single-phase three-leg, three-phase three-leg, or three-phase five-leg structure. Side legs that are not wound by the windings in the single-phase three-leg or three-phase five-leg structure can be structured as similar to the yokes 1B to 1D shown in the embodiments in the name of "side yokes".

What is claimed is:

1. A stationary induction electric apparatus, wherein the main body of the stationary induction electric apparatus is configured by including an iron core having, at least, two iron core legs and a winding wound around each iron core leg;

the iron core is configured as a winding iron core block group obtained in such a manner that three or more winding iron core blocks each of which is obtained by bending laminated magnetic metal ribbons in a circular shape are arranged and combined in the width direction of the magnetic metal ribbons;

the winding iron core blocks configuring the winding iron core are configured in such a manner that the magnetic metal ribbons having a specific width are laminated to form one winding iron core block, the magnetic metal ribbons are laminated to have a larger laminated thickness in the winding iron core block nearer the middle of the width direction of the magnetic metal ribbons, and the winding iron core block located in the middle of the width direction of the magnetic metal ribbons has a larger width than those located at the both ends;

each of the iron core legs of the winding iron core is configured in such a manner that the winding iron core blocks are centered in the laminated direction of the magnetic metal ribbons and the cross-section of each iron core leg in the width direction and the laminated direction of the magnetic metal ribbons is formed substantially in a circular shape; and at least one yoke of the winding iron core is arranged while side faces of the winding iron core blocks in a window are aligned on the same plane.

2. The stationary induction electric apparatus according to claim 1, wherein the winding iron core has side yokes, and at least one side yoke is arranged while side faces of the winding iron core blocks in the window are aligned on the same plane.

3. The stationary induction electric apparatus according to claim 1, wherein the winding iron core has side yokes, and at least one side yoke is arranged while side faces of the winding iron core blocks outside the window are aligned on the same plane.

4. The stationary induction electric apparatus according to claim 1, wherein the iron core legs are installed so as to be erected in the gravity direction, an upper yoke is arranged while side faces of the winding iron core blocks in the window are aligned on the same plane, and a plate-like iron core support member is arranged on the lower side of the upper yoke to support the upper yoke.

5. A stationary induction electric apparatus, wherein the main body of the stationary induction electric apparatus is configured by including an iron core having, at least, two iron core leg and a winding wound around each iron core leg;

the iron core is configured as a winding iron core block group obtained in such a manner that three or more winding iron core blocks each of which is obtained by bending laminated magnetic metal ribbons in a circular shape are arranged and combined in the width direction of the magnetic metal ribbons;

the winding iron core blocks configuring the winding iron core are configured in such a manner that the magnetic metal ribbons having a specific width are laminated to form one winding iron core block, the magnetic metal ribbons are laminated to have a larger laminated thickness in the winding iron core block nearer the middle of the width direction of the magnetic metal ribbons, and the winding iron core block located in the middle of the width direction of the magnetic metal ribbons has a larger width than those located at the both ends;

each of the iron core legs of the winding iron core is configured in such a manner that the winding iron core blocks are centered in the laminated direction of the magnetic metal ribbons and the cross-section of each iron core leg in the width direction and the laminated direction of the magnetic metal ribbons is formed substantially in a circular shape;

at least one yoke of the winding iron core is arranged while side faces of the winding iron core blocks in a window are aligned on the same plane; and at least one yoke of the winding iron core is arranged while side faces of the winding iron core blocks outside the window are aligned on the same plane.

6. The stationary induction electric apparatus according to claim 5, wherein the winding iron core has side yokes, and at least one side yoke is arranged while side faces of the winding iron core blocks in the window are aligned on the same plane.

7. The stationary induction electric apparatus according to claim 5, wherein the winding iron core has side yokes, and at least one side yoke is arranged while side faces of the winding iron core blocks outside the window are aligned on the same plane.

8. The stationary induction electric apparatus according to claim 5, wherein the iron core legs are installed so as to be erected in the gravity direction, an upper yoke is arranged while side faces of the winding iron core blocks in the window are aligned on the same plane, and a plate-like iron core support member is arranged on the lower side of the upper yoke to support the upper yoke.

* * * * *